US009677009B2

(12) United States Patent
Reyes Avila et al.

(10) Patent No.: US 9,677,009 B2
(45) Date of Patent: Jun. 13, 2017

(54) PROCESS FOR DEMULSIFICATION OF CRUDE OIL IN WATER EMULSIONS BY MEANS OF NATURAL OR SYNTHETIC AMINO ACID-BASED DEMULSIFIERS

(71) Applicant: INSTITUTO MEXICANO DEL PETROLEO, Mexico City (MX)

(72) Inventors: Romeo Jesus Reyes Avila, Mexico City (MX); Rafael Martinez Palou, Mexico City (MX); Ricardo Ceron Camacho, Mexico City (MX); Alba Adriana Vallejo Cardona, Mexico City (MX); Rafael Rodriguez Dominguez, Mexico City (MX); Benjamin Chavez Gomez, Mexico City (MX); Jorge Arturo Aburto Anell, Mexico City (MX)

(73) Assignee: INSTITUTO MEXICANO DEL PETROLEO, Mexico City (MX)

( * ) Notice: Subject to any disclaimer, the term of this patent is extended or adjusted under 35 U.S.C. 154(b) by 124 days.

(21) Appl. No.: 14/296,130

(22) Filed: Jun. 4, 2014

(65) Prior Publication Data

US 2014/0360920 A1 Dec. 11, 2014

(30) Foreign Application Priority Data

Jun. 5, 2013 (MX) ..... MX/A/2013/006306

(51) Int. Cl.
*C10G 33/04* (2006.01)
*C10G 33/00* (2006.01)
(Continued)

(52) U.S. Cl.
CPC ..... *C10G 33/04* (2013.01)

(58) Field of Classification Search
CPC ..... C10G 33/00; C10G 33/02; C10G 33/04; C10G 33/08
See application file for complete search history.

(56) References Cited

U.S. PATENT DOCUMENTS 2,077,230 A * 4/1937 Bernhard Keiser ... C10G 33/04 516/161
5,100,582 A 3/1992 Bhattacharyya
(Continued)

OTHER PUBLICATIONS

Fortuny, M. et al., Effect of Salinity, Temperature, Water Content, and pH on the Microwave Demulsification of Crude Oil Emulsions, 2007, Energy & Fuels, vol. 21, p. 1358-1364.*
(Continued)

*Primary Examiner* — Renee Robinson
*Assistant Examiner* — Derek Mueller
(74) *Attorney, Agent, or Firm* — Dickinson Wright PLLC

(57) ABSTRACT

The present invention relates to a process for breaking of preferred, but not exclusive, oil-in-water emulsions (O/W) and water separation from crude oil emulsions using surfactants as demulsifying agents derived from natural or synthetic amino acids, which are water soluble. The surfactants are of the methanesulfonate series of glycine ester derivatives with hydrocarbon chains, preferably between $C_{10}$ and $C_{16}$, at a concentration between 450 and 900 ppm, at a temperature range of 30 to 60° C. The removal of water from the crude oil by using natural or synthetic amino acid-based demulsifiers is highly efficient (about 80%) and complemented with the action of an electric field typically used in electrostatic separators in crude oil terminals ad oil refineries, increasing the efficiency of water separation substantially, and enabling the production of dehydrated crude oil for further processing.

14 Claims, 1 Drawing Sheet

Water/Oil Emulsion Microdroplet Dispersion. O, only emulsion; C, 1ml water emulsion, without EAI. Gly-10C, Gly-12C y Gly-14C; Tensoactive Addition Emulsions EAI.

(51) Int. Cl.
*C10G 33/02* (2006.01)
*C10G 33/08* (2006.01)

(56) References Cited

U.S. PATENT DOCUMENTS

| | | | |
|---|---|---|---|
| 6,211,141 | B1 | 4/2001 | Yamaguchi et al. |
| 6,294,093 | B1 | 9/2001 | Selvarajan et al. |
| 7,662,225 | B2 | 2/2010 | Antoine et al. |
| 7,829,521 | B2 | 11/2010 | Antoine et al. |

OTHER PUBLICATIONS

Amino Acids & Peptides, The Bowers Group, University of California at Santa Barbara, https://labs.chem.ucsb.edu/bowers/michael/research/aa-peptides/zwitterions/ (retrieved Sep. 2, 2016).*

Manning, F. et al., Water-in-Crude-Oil Emulsions, Oilfield Processing, vol. 2, Penn Well Publishing Company, 1995.

Gafonova, O. et al., The Stabilization of Water-in-Hydrocarbon Emulsions by Asphaltenes and Resins, Journal of Colloid and Interface Science 241, 469-478 (2001).

Grace, R., Commercial Emulsion Breaking, Advances in Chemistry Series, 1992, 313-339.

Kokal, S., Crude Oil Emulsions, Petroleum Engineering Handbook—vol. 1, Society of Petroleum Engineers, 2006.

Xia, J. et al., An Overview of the Basis, Technology, and Surface Phenomena of Protein-Based Surfactants, Marcel Dekker, 2001.

Infante, M.R. et al., Amino Acid-Based Surfactants, Ed. K. Holmberg 2003, 193-216.

Takehara, M., Properties and Applications of Amino Acid Based Surfactants, Colloids and Surfaces, 38 (1989) 149-167.

Husmann, M., Surfactants Derived from Naturally-Occuring Amino Acids, SOFW Journal (2008) 134, 34-40.

* cited by examiner

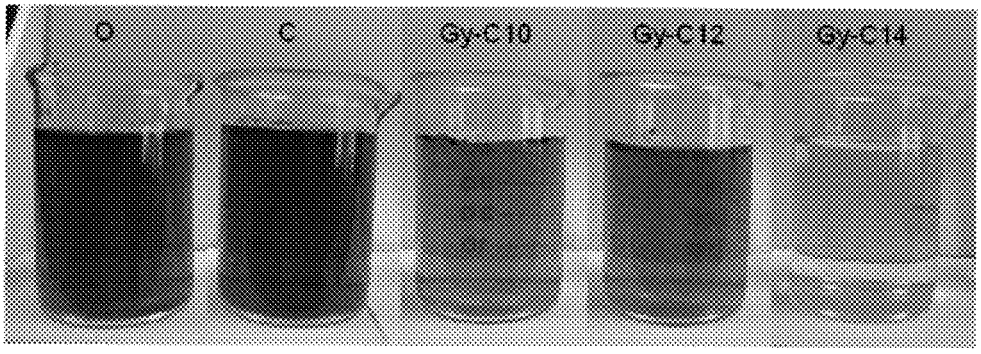
Water/Oil Emulsion Microdroplet Dispersion. O, only emulsion; C, 1ml water emulsion, without EAI. Gly-10C, Gly-12C y Gly-14C; Tensoactive Addition Emulsions EAI.

PROCESS FOR DEMULSIFICATION OF CRUDE OIL IN WATER EMULSIONS BY MEANS OF NATURAL OR SYNTHETIC AMINO ACID-BASED DEMULSIFIERS

CROSS-REFERENCE TO RELATED APPLICATION

This application claims the benefit and priority under 35 U.S.C. §119 to Mexican Patent Application No. MX/a/2013/006306 with a filing date of Jun. 5, 2013, the disclosure of which is incorporated herein by reference in its entirely.

FIELD OF THE INVENTION

The present invention relates to the application of chemical derivatives of natural or synthetic amino acids with surfactant and demulsifying properties which can be used for water separation from crude oil-in-water emulsions, water-in-oil and more complex emulsions. Chemical agents derived from amino acids are water soluble and are added in order to destabilize crude oil in water emulsions at a concentration between 50 and 1500 ppm and a temperature range between 25 to 80° C. The separation efficiency of water determined by Karl Fischer titration reaches up to 78% and when supplemented with an electrochemical process, the efficiency increases to 91.7-95%.

The invention also relates to the transport by pipeline of heavy, extra-heavy crude oils, bitumen, or shale oil from a well or deposit to terminal tanks, oil tankers, and refineries. Such crude oils may be transported by pipelines as a crude oil in water emulsion to terminals and refining installations, requiring the emulsions to be broken and dewatering to obtain a crude oil within required specifications prior to further processing in refineries or burned.

BACKGROUND OF THE INVENTION

Crude oil in water emulsions can be found in all stages of production, transportation and processing of petroleum industry. An emulsion is defined as a system in which a fluid is relatively dispersed or distributed in the form of droplets (dispersed phase) in another immiscible liquid (continuous phase). The water-in-on (W/O), oil-in-water (O/W) and more complex emulsions are formed during the production of crude oil, which is often accompanied by water, and their transportation by pipeline. The dispersion of droplets of water in oil or oil in water is to be formed by the simultaneous action of sufficient mixing energy (U.S. Pat. No. 5,100,582) and by the presence in the oil of an emulsifying agent or external addition of them.

The emulsifying agents are chemicals that show surface activity reducing the surface tension of the interface when another phase is present. Emulsifying agents are also called surfactants. They are also characterized by a double affinity conferred by their molecular structure with an amphiphilic character, a part of the molecule is hydrophilic (polar character) or soluble in water and the other is lipophilic (non-polar character) or soluble in oil or non-polar solvents. The non-polar counterpart of the molecule generally is formed from a long alkyl chain. This type of structure enables them to be adsorbed and placed on the water/oil and oil/water interface, forming aggregates whose hydrophilic portions are oriented towards the aqueous environment and the hydrophobic fractions to the oily environment, decreasing then the interfacial or surface tension which allows the formation of the emulsion.

In crude oil, there are naturally occurring components that act as emulsifiers, which are located in the polar crude oil fraction, such as asphaltenes, resins, soluble organic acids (naphthenic acids). These compounds are the major constituents of the interfacial film surrounding the droplets of water, lowering the interfacial tension and preventing droplet coalescence, giving natural stability to emulsions of crude oil.

In the petroleum industry, the typical emulsions encountered are water droplets dispersed in the oil phase and called as W/O emulsion or direct emulsion. The remaining amount of emulsified water ranges from about 1 to 60% volume. In crude medium to light (>20° API), emulsions typically contain from 5 to 20% volume of water, whereas in heavy oil (<20° API) are often in the range of 10 to 35% water (Manning F S, Thompson R E, Oilfield processing. Volume 2 Crude oil, Penn Well Publishing Company, 1995).

Moreover, the formation of relatively stable O/W emulsions from heavy, extra-heavy crude oil, bitumen and shale oil is a recurring technological alternative for improving the flowability of such oils, since its specific gravity and high viscosity make difficult their transportation and further processing. High viscosity and density are mainly due to the presence of asphaltenes in concentrations which can reach 20% by weight. The specific risks during transportation of heavy oils by pipeline are high pressure drops, plugging and blockage, causing stoppages or decline on production. Conventional technology for extraction and transportation are frequently not suitable for transporting such heavy crude oils.

An effective method for reducing the viscosity of heavy oils is the formation of O/W emulsions known as inverse emulsions with the aid of an emulsifying agent. These kinds of emulsions are commonly not formed spontaneously and to ensure emulsion stability during transport in the pipeline it is necessary to add emulsifiers (usually surfactants). The surfactants selected should allow the formation as a sufficient stable emulsion for their transportation by pipelines and after that, an easy process of breaking the emulsion in the refinery and the recovery of water-free crude oil. The emulsions prepared for pipeline transport contain about 70-75% oil and the balance of water.

The formation of aqueous emulsions is useful for the transportation of crude oil. However, water should be separated before refining the crude oil due to economic and operational reasons. The emulsion breaking is a critical step in the production of crude oil, both to meet production targets and delivery specifications to processing centers. therefore, it is important to develop formulations of demulsifier agents to achieve adequate separation of the water present in the crude oil.

Aggregation, coalescence and sedimentation of crude oil must occur for breaking O/W emulsions and separation of crude oil and water. Commonly, this is achieved by methods including thermal, mechanical, chemical and electric processes (Gafonova, O. V.; Harvey, W. Y.; J. Colloid Interface Sci. 2001, 241, 469-478).

Chemical demulsification is the preferred method applied to the treatment of W/O and O/W emulsion and includes the use of chemicals (demulsifiers), which are also surface active agents which promote the process of emulsion breaking. The stability of an emulsion is strongly affected by the nature of the interfacial film and surfactant adsorption mechanisms. The most common application of the demulsification process in refineries includes the combination of heat and chemicals to neutralize and eliminate the effects of the natural emulsifying agents (Grace, R., Advances in Chemistry Series, 1992, 313-339) usually assisted by electrostatic dehydrators.

The role of the demulsifiers is to destroy the protective action of the hydrophobic film formed by emulsifier agents and allow the coalescence of the water droplets. The demulsifiers working with good efficiency for a given emulsion, may be totally ineffective in another. Typically, surfactants are classified by their ionization state in an aqueous phase as anionic, cationic and nonionic surfactants (U.S. Pat. No. 6,294,093).

Most of commercial demulsifiers have been mostly designed to break W/O emulsion, which is the type of emulsion naturally occurring during crude oil production, and are generally of the non-ionic type surfactant formulated with polymeric chains of ethylene oxide and propylene oxides, ethoxylated phenols, ethoxylated alcohols and amines, ethoxylated resins, polyhydric alcohols and salts of sulfonic acids, among others (Kokal, S L. Petroleum Engineering. Vol. 1, Society of Petroleum Engineers, 2006). Frequently, demulsifier formulation consist of a mixture of several basic commercial agents dissolved in an organic solvent, such as aromatic naphtha, benzene, toluene or isopropyl alcohol, among others.

It is known that the combination of polar amino acids (hydrophilic portion) containing non-polar (hydrophobic) long alkyl chains produces amphiphilic molecules with high surface activity and rapid biodegradation, which make them acceptable from an environmental point of view and for this reason in recent years have taken great interest. Literature reports the experimental and commercial synthesis of short-chain amino acids from aspartic acid, glutamic acid, arginine, alanine, glycine, leucine, proline, serine and protein which have been used as surfactants (Nnanna, I. A.; Xia, J. Protein-based surfactants, synthesis, physicochemical properties and applications. Marcel Dekker, 2001).

The first applications of amino acid-based surfactants was described for preserving drugs since these compounds were effective against various bacteria and viruses that cause diseases (Infante, M R., Perez, L., Pinney, A.; Clapes, P.; Moran, M C, Amino acid-based surfactants. In Novel Surfactants, Ed K. Holmberg 2003, 193-216). With the reduction of production costs, amino acid-based surfactants have been used as additives for food, flavor, and pharmaceutical applications (Takehara, M. Colloids Surf., 1989, 38, 149-167), and extensive research has been done for their application of cosmetic manufacture (Husmann, M. SOWF J. 2008, 134, 34-40). However, these publications do not disclose their use as demulsifiers for crude oil in water emulsions in the oil industry.

The U.S. Pat. No. 6,211,141 discloses the use of glycine as part of the formulation of a detergent powder. U.S. Pat. No. 7,662,225 discloses the use of glycine betaine amides for the formulation of surfactants to form stable aqueous emulsions of bitumen for the production of road surfaces.

In U.S. Pat. No. 7,829,521, the composition of surfactants made from esters or amides of glycine betaine is described and their application is related to the cosmetic area in the formulation of liquid soap, foam, shower gel and shampoo.

The referred patents correspond to the application of betaine derivatives, salt of (carboxymethyl)trimethylammonium or trimethylglycine in the formulation of detergents or cleaning agents or for the formation of aqueous emulsions of bitumen used in paving roads.

SUMMARY OF THE INVENTION

The present invention relates to the use of ionic ester derivatives of natural or synthetic amino acids as demulsifier agents of O/W or W/O emulsions, and mixtures thereof, resulting in the formation of two phases: crude oil and water. This invention aims to reduce the water content present in the crude oil, bitumen and shale oil and to allow compliance with the technical and economic requirements of the storage, transportation, refining and burning of such crude oils. The invention is particularly directed to a process for demulsifying and breaking emulsions by the addition of a methanesulfonate of $C_8$-$C_{22}$ alkyl amino acid ester.

The process of the invention is basically directed to a process for demulsifying and breaking emulsions of crude oil. The invention is particularly directed to demulsifying crude oil-in-water emulsions (O/W), water-in-crude oil emulsions (W/O) and complex emotions using natural or artificial amino acid ester derivatives as demulsifying agents. The process of the invention basically comprises the steps of selecting a demulsifying agent selected from the group consisting of natural and artificial amino acid ester derivatives which have surfactant properties. The demulsifying agents are preferably a methane sulfonate of an ionic amino acid ester of $C_8$-$C_{22}$. The demulsifying agent is selected according to the type of crude oil and the oil-in-water emulsion being treated. An amount of the water-soluble ionic amino acid ester demulsifying agent is added to the oil-in-water emulsion to provide a demulsifying agent concentration of 50-1500 ppm, and preferably 850-900 ppm based on the amount of the emulsion. The resulting mixture is mixed and stored under static conditions at a temperature of 25-80° C. and preferably 30-60° C. for at least 24 hours. The crude oil and water phases are then separated and recovered.

The crude oil phase of the emulsion can be light, medium, heavy, extra heavy crude oil, bitumen, shale oil, and mixtures thereof. The oil-in-water emulsions can have a water content of 20-40%, and up to 30% by volume. The water phase of the emulsion can have a salinity of up to 60 g/L NaCl, and preferably between 20-50 g/L NaCl. The process of the invention can further include the step of light mixing to ensure homogeneous displacement of the emulsifying agent into the emulsion and applying electric field or current to the oil-in-water emulsion for a short period of time. The electric current is applied for up to 60 minutes, and preferably 10-30 minutes, after additional mixing of the amino acid-based demulsifying agent. In one embodiment, the electric current can be about 30V, although other voltages and currents can be used.

The demulsifying agents of the invention are methanesulfonates of amino acid esters that are water soluble and capable of dispersing in the emulsion and breaking the oil-in-water crude oil emulsion. In preferred embodiments, the amino acid esters are derived from glycine, alanine and tryptophan. Other amino acids can be used that provide the water solubility and ability to break the oil-in-water emulsions. Examples of other amino acids include isoleucine, leucine, valine, phenylalanine and tyrosine. The amino acid esters can be obtained from an alcohol having a $C_8$-$C_{22}$ chain and preferably a $C_{10}$-$C_{16}$ chain. The alcohol can be a straight chain alcohol. In one embodiment of the invention, the demulsifying agents are methanesulfonates of $C_8$-$C_{22}$ alkyl amino acid esters.

BRIEF DESCRIPTION OF THE DRAWINGS

In order to provide a clear and accurate description of the present invention, reference will be made to the accompanying FIGURE.

FIG. 1 shows a homogeneous dispersion of crude oil droplets in water from an O/W emulsion in controls O and C, indicating that emulsion is not broken. After addition of the ionic amino acid esters (IAAE) of the present invention, breakage of emulsion and formation of a crude oil phase at the top of aqueous phase is observed.

DETAILED DESCRIPTION OF THE INVENTION

The present invention relates to the process of demulsifying preferably, but not exclusively, crude oil emulsions in water by the use of demulsifier agents derived from natural or synthetic amino acids. Thus, this process comprises the destabilization and breaking of O/W emulsions and the removal of water using ionic amino acid esters (IAAE) derived from naturally occurring amino acids such as, but not limited to, glycine, alanine and tryptophan; as well as synthetic amino acids.

The IAAE are water soluble substances and present surfactant properties that favor the breaking of O/W emulsions and improve the separation of water from the crude oil phase. They can be applied as demulsifiers in breaking O/W emulsions in which the dispersed phase is crude oil with gravity, viscosity and salinity, preferably but not exclusively at or below 20° API, greater than or equal to 103 centipoise at 30° C. and less than 5%, respectively. The emulsified crude oil may be one or mixtures of petroleum types known as light, middle, heavy, extra-heavy, bitumen and shale oil.

The process of O/W emulsion destabilization and dehydration takes place according to the following points.

1. Use of demulsifiers agents of O/W emulsions comprised by, preferably but not exclusively, methanesulfonates series of esters derived from glycine, alanine and tryptophan with a hydrocarbon chain from $C_8$ to $C_{22}$ (IAAE), and preferably between $C_{10}$ and $C_{16}$.

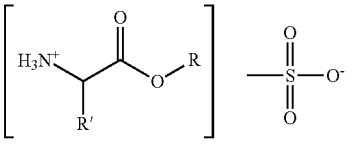

R = $C_8$-$C_{22}$ $R^1$ is an alkyl, arylalkyl or aryl group. In one embodiment, $R_1$ is selected from the group consisting of H, $CH_3$ and

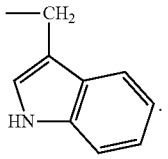

R can be a $C_8$-$C_{22}$ straight chain alkyl. In other embodiments, R can be a $C_{10}$-$C_{16}$ alkyl which can be a straight chain alkyl.

2. Dissolution of demulsifier (IAAE) in water in order to reach a concentration in the O/W emulsion, preferably but not exclusively between 100 to 900 ppm.

3. Determination of the water content in the emulsion can be done by potentiometric technique, known as Karl-Fisher titration, according to ASTM method D 4377.

4. When the O/W emulsion has 30% w/w of water, the addition of the concentrated solution of the emulsifier should preferably be in a v/v ratio of 1:9 (emulsifier/emulsion), but other ratios may be used. After addition of demulsifier, the entire dispersion should be briefly mixed, sufficiently to allow the demulsifier to dispense and act on the emulsion. Then, the vessel (container) must be left standing to allow static separation of the aqueous and oily phases. Further water separation can be obtained by centrifugation, mixing, and comprising also heating and electric field-based methods. For O/W emulsions containing heavier crude oils as extra-heavy, bitumen and/or shale oil, the supplemental addition of solvents (toluene, benzene, ethanol, isopropanol, etc), petroleum condensates, lighter crude oils, and/or biodiesel must be required in order to reach adequate levels of dehydration of final crude oil and less than 0.5% of water.

5. Storage conditions, for settling and allowing separation of water and crude oil phases, depends on the characteristics of crude oil and added emulsifier (IAAE). With some demulsifiers (IAAE) at a recommended concentration of 900 ppm, high efficiencies of water removal are obtained at a temperature range between 30 to 60° C. At IAAE concentrations below 450 ppm, a high efficiency is achieved by maintaining a temperature near 60° C. or higher (60-150° C.). The efficiency of water removal from the crude oil can be increased by centrifugation, the use of mechanical separator and electric field application.

6. The efficiency of water separation and dehydration of crude oil is calculated based on the volume of separated water in a storage time not exceeding preferentially 24 hours. A more precise water content determination in crude oil may be done by potentiometric Karl-Fisher titration.

7. An alternative to speeding up the process of demulsification, besides the addition of further demulsifier, consists on applying of a direct current electric field of 500 to 3000 Volts for less than 30 minutes to the mixture demulsifier-O/W emulsion, which substantially reduces the residual water content in the crude oil.

One main reason for using amino acid-based compounds, as O/W emulsion demulsifiers, is by their biodegradability and low toxicity (Pérez, L., Pinazo, A., García, M, T., Morán, M. D. C., Infante, M. R. 2004, New Journal of Chemistry, 28(11), 1326-1334), high water solubility, they maintain their surfactant properties at room temperature and preferably within a range up to 100° C. and because their synthesis is simple, fast and efficient (Cerón-Camacho, R.; Aburto, J.; Montiel, L. E.; Flores E. A.; Cuellar, F.; Martínez-Palou, R. 2011. Molecules. 16, 8733-8744).

Table 1 shows some ionic amino acid esters (IAAE) considered in the present invention and their effectiveness as demulsifiers was evaluated using emulsions of crude oil having a water content of 30% (w/w). The O/W emulsion was unstabilized and water and crude oil phases separate by gravity, leaving a remainder of water dispersed in the crude oil of about 4-6%. The application of an electric field to the crude oil allowed further dehydration to water contents lower than 2%.

TABLE 1

Structure of demulsifiers based on esters of ionic amino acids (IAAE).

| Code | Demulsifier's name | Cation | Anion |
|---|---|---|---|
| Gly-8C | 2-(octyloxy)-2-oxoethanaminium | 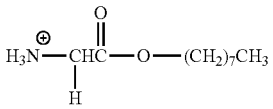 | 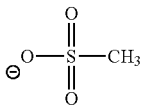 |
| Gly-10C | 2-(decyloxy)-2-oxoethanaminium | 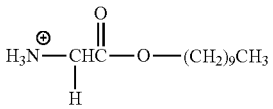 | |
| Gly-12C | 2-(dodecyloxy)-2-oxoethanaminium | 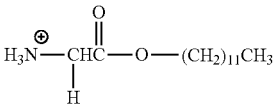 | |
| Gly-14C | 2-(tetradecyloxy)-2-oxoethanaminium | 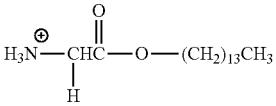 | |
| Gly-16C | 2-(hexadecyloxy)-2-oxoethanaminium | 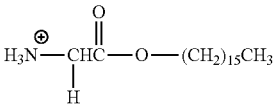 | |
| Gly-18C | 2-(octadecyloxy)-2-oxoethanaminium | 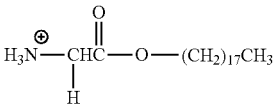 | |
| Ala-14C | 2-(tetradecyloxy)-1-oxopropan-2-aminium | 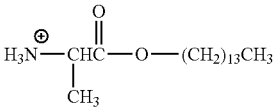 | |
| Trip-14C | 1-tetradecyloxy-3-(1H-indol-3-yl)-1-oxopropan-2-aminium | 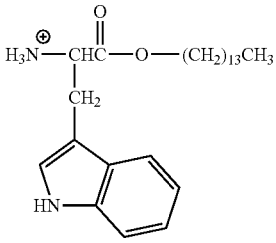 | |

EXAMPLES

Some examples of the present invention are described below, and these examples did not constrain or limit the scope of this invention.

Example 1

Destabilization of O/W emulsions with commercial surfactants and demulsifiers of IAAE at 30° C.

Emulsion Preparation

To prepare the O/W emulsion, heavy crude oil with 21.1 API density was used as the oil phase, and contained asphaltenes and sulfur in amounts of 13.6 and 3.4%, respectively. An aqueous saline solution at a concentration of 23.5 g/L of NaCl was used and the commercial emulsifier based on alkyl phenol ethoxylate (15 moles of ethoxy groups) was employed. Subsequently an O/W emulsion was prepared using a homogenizer IKA Labortechnik being the water content in the emulsion of 30% (w/w).

Demulsification Test

The O/W emulsion was subjected to a process of chemical demulsifcation by adding the demulsifier agents and using graduated tubes with a conical bottom for easiness of water volume determination. Eight IAAE compounds were used as amino acid-based demulsifier. Likewise, eleven demulsifiers which are commercially available were selected and also evaluated for comparison. A concentrated solution of each demulsifier at 1% (w/v) was prepared and every solution was added to an O/W emulsion in a 1:9 ratio (v/v), being the final concentration of demulsifier of 1000 ppm in the O/W emulsion. Commercial demulsifiers were solubilized in toluene while IAAE in water, except for Trip-14C which was solubilized in toluene. After the addition and mixing of the respective demulsifier, the initial O/W emulsion was allowed to settle under static conditions at 30° C. After 24 hours, the conical flasks were centrifuged at 5000 rpm for 10 min. Then, two conical flasks with O/W emulsions and 1 mL of toluene (T) or 1 mL of water (C) were prepared as controls (Blanks). A third control (O) with only O/W emulsion and without added demulsifier was prepared. The separated volume of water was measured after settling for 24 hours and after further centrifugation, Results.

The percentage of water removal efficiency calculated on the basis of total water content in the O/W emulsion is presented in Table 2. The blanks (T and O) showed less than 30% of water removal efficiency. For commercial demulsifier agents, the higher efficiency (40.5%) was obtained with Span 20 and Aliquat 336, and even some commercial demulsifier agents reached less water removal efficiency than the Blank without demulsifier (O). In all O/W emulsions treated with commercial demulsifiers, no significant improvement in water removal efficiency was observed after centrifugation.

TABLE 2

Water removal efficiency (WRE, %) from O/W emulsions in the presence of commercial and amino acid-based demulsifiers on static conditions at 24 h and 30° C. and after centrifugation (dc).

| Commercial demulsifiers | WRE (%)[d] 24 h | WRE (%)[d] dc | Amino acid-based demulsifiers | WRE (%)[d] 24 h | WRE (%)[d] dc |
|---|---|---|---|---|---|
| Brij 30 | 32.4 | 37.8 | Gly-8C | 43.2 | 59.5 |
| Brij 72 | 32.4 | 37.8 | Gly-10C | 62.2 | 81.1 |
| Brij 52 | 32.4 | 32.4 | Gly-12C | 59.5 | 81.1 |
| Igepal CO-210 | 35.1 | 37.8 | Gly-14C | 67.6 | 86.5 |
| Igepal CO-520 | 37.8 | 43.2 | Gly-16C | 48.6 | 64.9 |
| Span 20 | 40.5 | 45.9 | Gly-18C | 43.2 | 62.2 |
| Brij 58 | 21.6 | 32.4 | Ala-14C | 43.2 | 67.6 |
| Aliquat 336 | 40.5 | 54.1 | Trip-14C | 24.3 | 45.9 |
| Brij S20 | 21.6 | — | T[a] | 24.3 | 40.5 |
| Brij 98 | 32.4 | — | O[b] | 26.7 | 40.0 |
| Igepal CO-720 | 24.3 | 59.5 | C[c] | 37.8 | 45.9 |

[a]Blank of emulsion with 1 mL toluene.
[b]Blank of emulsion without demulsifier.
[c]Blank of emulsion with 1 mL water.
[d]WRE determined by Karl-Fisher (Mean value of three repetitions).

With the IAAE demulsifiers, water removal efficiencies over 60% were obtained at 24 h and 30° C. (Table 2). The WRE substantially incremented after centrifugation, but the use of IAAE demulsifiers allowed a higher WRE value when compared with commercial agents. The WRE with Gly-10C, Gly-12C and Gly-14C was between 60-67% after gravity separation at 24 h and WRE increased over 80% after centrifugation. Thus, these three amino acid-based demulsifiers have the best performance in the destabilization of the O/W emulsion, which was confirmed by the test of pouring a crude oil droplet in water, which resulted in its complete insolubility and without dispersion of crude oil was observed. When the O/W emulsion still remains, the crude oil droplets dispersed into the water phase.

Blanks O and C show a homogeneous dispersion of the O/W emulsion, in water and indicating that no breaking took place. On the other side, the presence of Gly-10C and Gly-12C caused the diminution of the dispersion of O/W emulsion in water, becoming scarce with Gly-14C and indicating the breaking of the initial OM emulsion, i.e. the emulsion broke out and the crude oil immediately migrated to the water surface. The latter confirmed that glycine-based demulsifiers with 10, 12 and 14 chain carbon present higher efficiencies for breaking O/W emulsions out when compared to selected commercial demulsifiers.

Example 2

Application of Gly-10C, Gly-12C and Gly-14C as demulsifiers of O/W emulsions at different concentration and temperature between 30-60° C.

O/W Emulsion Preparation

The same crude oil and procedure for O/W emulsion preparation described for the example 1 was used.

Demulsification Test

Three amino acid-based demulsifiers Gly-10C, Gly-12C and Gly-14C of the methanesulfonate series were evaluated at different concentrations and test temperature. The initial content of water in the O/W emulsion (as measured by Karl-Fisher) as in Example 1, was of the order of 30% and the salinity of the aqueous phase of 23.5 NaCl.

The method of preparation and addition of the amino acid-based demulsifiers is the same as described in Example 1, by adjusting to the required concentration for each initial O/W emulsion according to the conditions indicated in Table 3. Subsequently, the emulsions were stored for 24 hours at the indicated temperatures.

TABLE 3

Conditions for applying the emulsifier. nC = carbon number in the hydrocarbon chain. O30, O45 and O60; reference O/W emulsions keep at 30, 45 and 60° C.

| O/W Emulsion | Conditions: Gly-nC | Conditions: [amino acid-based demulsifier] (ppm) | Conditions: Temp. (° C.) |
|---|---|---|---|
| E4 | 10 | 900 | 60 |
| E2 | 10 | 900 | 30 |
| E9 | 12 | 500 | 45 |
| E7 | 14 | 100 | 60 |
| E8 | 14 | 900 | 60 |
| E5 | 14 | 100 | 30 |
| E6 | 14 | 900 | 30 |
| O30 | | | 30 |
| O45 | | | 45 |
| O60 | | | 60 |

The effect of amino acid-based demulsifiers on O/W emulsions was measured by two methods: the first corresponds to the efficiency of water removal, with reference to the initial volume of the total water in the O/W emulsion and the volume of water separated after 24 hours and after centrifugation at 5000 rpm for 10 min. The second was in terms of residual water content in separated crude oil measured by potentiometric Karl-Fisher titration, at 24 hours and after centrifugation.

Results.

The results obtained with each initial O/W emulsion are shown in Table 4, In control assays, the O/W emulsion without demulsifier, does not change significantly and the value of RWE is below compared to the O/W emulsions treated with demulsifier.

Even after centrifugation, the content of remaining water in separated crude oil was between 11-18.6%.

Furthermore, the O/W emulsion is destabilized and the RWE increased with temperature and dosage of the amino acid-based demulsifier. After 24 hours under static conditions, have high efficiencies of water removal and the remaining content of water in the crude oil (as measured by the Karl-Fisher method) was reduced to 6.5% and after centrifugation to 1.04% for E8 and E6 assays. The demulsifier Gly-14C has the advantage that its application at 30° C. and 900 ppm, reaches a similar reduction of the water content of separated crude oil obtained at 60° C.

TABLE 4

Removal water efficiencies (vol %) and water content of separated crude oil (wt %) after settling by 24 hours and after centrifugation (dc).

| O/W | RWE (%)[a] | | Water content of the separated crude oil (wt %)[b] | |
|---|---|---|---|---|
| Emulsion | after 24 h | dc | after 24 h | dc |
| E4 | 62.2 | 75.7 | 6.5 | 1.04 |
| E2 | 45.9 | 78.4 | 16.3 | 1.4 |
| E9 | 51.4 | 64.9 | 15.8 | 1.8 |
| E7 | 48.6 | 51.4 | 12.6 | 3.86 |
| E8 | 64.9 | 75.7 | 6.6 | 1.41 |
| E5 | 40.5 | 48.6 | 24.4 | 5.7 |
| E6 | 59.5 | 86.5 | 6.4 | 1.3 |
| O30 | 23.3 | 30.0 | 26.2 | 18.6 |
| O45 | 26.7 | 33.3 | 20.2 | 14.7 |
| O60 | 33.3 | 40.0 | 15.3 | 11.1 |

[a]Removal water efficiency (%) = (vol. of water separated/vol. initial of water) × 100.
[b]Determined by Karl-Fisher titration.

Example 3

Employing amino acid-based demulsifier Gly-14C and further application of an electric field.

O/W Emulsion Preparation

The emulsion was prepared in the same way as described in example 1.

Demulsification Test

Gly-14C demulsifier dosed at concentrations between 0-900 ppm was used for destabilization and dehydrating of O/W emulsion. The initial content of total water in the O/W emulsion was approximately 31-33% (as measured by Karl-Fisher).

An electrolytic cell consisting of a glass vessel, two carbon steel electrodes (anode and cathode) of 2 $cm^2$ are connected to a power source of direct energy GwINSTEK CPC-30300. In the electrolytic cell, the O/W emulsion and the Gly-14C demulsifier were poured and an electric current of 30 Volts was applied for 6-10 min. The changes in water content of separated crude oil (by Kari-Fisher titration) were measured at 15 minutes and after 24 hours of electric field at room temperature.

Results.

Table 5 includes obtained results from demulsification tests. On average, the water content in the initial O/W emulsion was 31.2-33.3%. The application of an electric field to such O/W emulsion has an immediate effect in emulsion destabilization and the water content of separated crude oil decreases in all cases.

TABLE 5

Water content (%) in the initial O/W emulsion and crude oil after treatment with Gly-14C at different concentration under an electric field (30 V, 15 min).

| | Dosage of Gly-C14, ppm | | | | |
|---|---|---|---|---|---|
| | 0 | 100 | 450 | 900 | 900 (s/v)[a] |
| | Water content (%) | | | | |
| Initial O/W emulsion | 31.2 | 31.2 | 33.3 | 33.3 | 30.2 |
| Crude oil with electric field | 18.8 | 12.8 | 6.1 | 2.9 | — |
| After 24 h of electric field treatment | 11.1 | 5.7 | 2.8 | 1.7 | 6.4 |
| | Water separated (%) after 24 h | | | | |
| | 64.5 | 81.9 | 91.7 | 95.0 | 78.8 |

[a]Without applying electric field.

In the presence of Gly-14C demulsifier, the remaining water content in crude oil is minimized with the demulsifier dosage and after the application of an electric field. The water content of crude oil is 18.8% when an electric current is applied without the addition of Gly-14C. This shows that O/W emulsion destabilization and crude oil dehydration may be possible in a relatively short time using an amino acid-based demulsifier and an electric field.

What is claimed is:

1. A process for demulsifying crude oil-in-water (O/W) emulsions, water-in-crude oil (W/O) or complex emulsions by demulsifying agents derived from natural or artificial amino acids, said process comprising the following steps:

a) selecting a demulsifying agent among the compounds derived from natural or artificial amino acids, which present surfactant properties, according to the O/W, W/O or complex emulsion, wherein said demulsifying agent is a water soluble, ionic amino acid ester, wherein the demulsifying agent comprises a methanesulfonate ester derivative of natural or synthetic amino acids with surface-active properties that include at least one selected from the group consisting of glycine, alanine and tryptophan containing a hydrocarbon chain from $C_8$ to $C_{22}$, and having the following general structure:

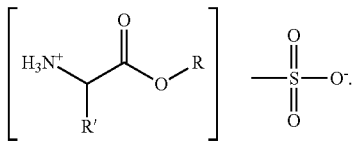

R = $C_8$-$C_{22}$ and where R' is selected from the group consisting of H, an alkyl group, arylalkyl group and aryl group, b) adding said water soluble ionic amino acid ester (IAAE) demulsifying agent to the O/W emulsion, water-in-crude oil or complex emulsion at concentrations between 50-1500 ppm to form a mixture, c) mixing the resulting mixture and storing the mixture under static conditions at temperatures between 25-80° C. for at least 24 hours, and d) separating and recovering crude oil and water phases.

2. The process of claim 1, where the emulsion comprises an oil phase selected from the group consisting of light crude oil, medium crude oil, heavy crude oil, extra heavy crude oil, bitumen, shale oil, and mixtures thereof.

3. The process for demulsification of O/W emulsions by use of demulsifying agents, according to claim 1, wherein the water content in the O/W emulsion is between 20-50%, and has a salinity of less than 60 g/L NaCl.

4. The process of demulsification of O/W emulsions using natural or synthetic amino acid-based demulsifying agents, in accordance with claim 1, wherein the step c) comprises mixing to ensure homogeneous displacement of the demulsifying agent into the emulsion, and d) comprises applying an electric field to the O/W emulsion after addition and mixing of the ionic amino acid ester demulsifying agent.

5. The process of claim 1, wherein the ionic amino acid ester demulsifying agent is added at a concentration of 450 to 900 ppm.

6. The process of claim 1, wherein the mixture of step (c) is stored at 30-60° C.

7. The process of claim 1, wherein R is a $C_{10}$-$C_{16}$ hydrocarbon.

8. The process of claim 3, wherein the water content of the emulsion has a NaCl content of 20-40 g/L.

9. The process of claim 4, wherein said electric field is applied for about 10-30 minutes.

10. The process of claim 1, where R' is an alkyl group.

11. A process for demulsifying aqueous crude oil emulsions comprising the steps of:

adding a water soluble ionic amino acid ester demulsifying agent to the crude oil emulsion in an amount of 50-1500 ppm based on the amount of the crude oil emulsion, wherein said demulsifying agent is

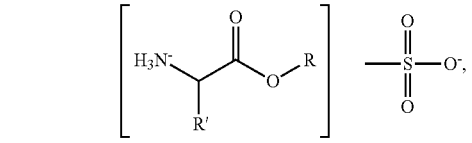

R = $C_3$—$C_{22}$ where R' is selected from the group consisting of H, an alkyl group, arylalkyl group, aryl group and

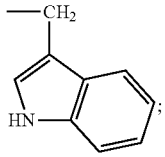

mixing the water soluble ionic amino acid ester demulsifying agent to form a mixture; and separating a crude oil phase and a water phase from said mixture.

12. The process of claim 11, wherein said emulsion is selected from the group of oil-in-water emulsions, water-in-oil emulsions, and complex emulsions and where said emulsion includes an oil phase selected from the group consisting of light crude oil, medium crude oil, heavy crude oil, extra heavy crude oil, bitumen, shale oil, and mixtures thereof.

13. The process of claim 11, wherein said mixture is mixed at a temperature of 25-80° C.

14. The process of claim 11, wherein said demulsifying agent is added in an amount of 450 to 900 ppm.

* * * * *